United States Patent [19]

Rogov et al.

[11] 4,239,112

[45] Dec. 16, 1980

[54] PLUG FOR ELIMINATING TROUBLESOME ZONES IN WELLS

[76] Inventors: Viktor F. Rogov, ulitsa Garibaldi, 30, korpus 2, kv. 70, Moscow; Nikolai K. Lipatov, ulitsa Mekhanizatorov, 1, kv. 4, Apatity Murmanskoi oblasti; Gennady V. Patrushev, ulitsa Dmitria Donskogo, 27/3, Novosibirsk; Ruben A. Tatevosian, ulitsa Gorkogo, 4, kv. 60; Mikhail Y. Titov, ulitsa Kominterna, 34/6, kv. 83, both of Moscow, all of U.S.S.R.

[21] Appl. No.: 47,249

[22] Filed: Jun. 11, 1979

[30] Foreign Application Priority Data

Jul. 6, 1978 [SU] U.S.S.R. ..... 2631353

[51] Int. Cl.[3] ..... B65D 83/00; B65D 77/10

[52] U.S. Cl. ..... 206/525; 229/62.5; 150/7

[58] Field of Search ..... 206/525, 582, 527, 805; 229/55, 62, 77, 65, 62.5; 150/7

[56] References Cited

U.S. PATENT DOCUMENTS

| | | | |
|---|---|---|---|
| 204,603 | 6/1878 | Pittman | 229/77 |
| 2,609,880 | 9/1952 | Dyer | 206/582 |
| 2,969,101 | 1/1961 | White | 229/55 |

FOREIGN PATENT DOCUMENTS

| | | | |
|---|---|---|---|
| 110352 | 4/1940 | Australia | 229/62 |

*Primary Examiner*—William T. Dixson, Jr.
*Attorney, Agent, or Firm*—Fleit & Jacobson

[57] ABSTRACT

A plug for eliminating troublesome zones in wells, comprising a plugging agent in the form of a dry quick-setting mixture packed in an elastic water-proof cylindrical chamber having the same diameter as the well being treated and whose bottom end is stoppered, whereas the top end thereof is provided with retainers and is shaped as a double strip formed by the walls of the cylindrical chamber and defined by two peripheral longitudinal seams running to the boundary line of the plugging agent, said strip being bent along said boundary line over the plug body so as to be forced thereagainst by said elastic retainers.

3 Claims, 3 Drawing Figures

PLUG FOR ELIMINATING TROUBLESOME ZONES IN WELLS

FIELD OF THE INVENTION

This invention relates to means for carrying a plugging mixture to the place of its application in the troublesome zone of a well, and has particular reference to a plug for eliminating troublesome zones in wells.

The invention is intended for application in carrying out geological prospecting work, engineering survey jobs and drilling-and-blasting operations aimed at eliminating fluid-loss and water-influx zones in wells, and also for consolidating unstable zones of wells.

BACKGROUND OF THE INVENTION

One prior-art plug for eliminating troublesome zones in wells is known to comprise a plugging agent in the form of a dry quick-setting mixture packed in an elastic water-proof cylindrical chamber having a diameter equal to the diameter of the well, the bottom end of said chamber being stoppered, while the top end is adapted to tightly close said chamber after said plugging agent has been packed therein.

In the known prior-art plugs the chamber thereof is closed by tying up, or by welding, or else by pasting the top end of the chamber along the boundary line of the plugging agent (cf., e.g., A Collection of Proceedings of the All-Union Research Institute for Prospecting Methods and Techniques entitled "Prospecting methods and techniques", No. 114, 1977, Leningrad, pp. 67–69).

When lowering the plugs down the well into the troublesome zone thereof, the dry quick-setting mixture is liable to get compacted as a result of its being exposed to the effect of high pressures and to all-round compression by the surrounding fluid.

As a result the air found in the mixture, is liable to accumulate into bubbles that destruct the walls of the chamber of the known plug before application of the mixture.

This leads to a premature hydration of the dry quick-setting mixture before its application in the troublesome zone of the well, its dilution (i.e., reducing a required concentration thereof) and to losing its activity and plugging ability.

All this contributes to overexpenditure of plugging agents and affects adversely the quality and productivity of sealing jobs involved in eliminating troublesome zones in wells.

Brief Description of the Invention

It is an object of the present invention to provide hermetic tightness and intactness of the plug chamber under conditions of a continuously rising all-round hydrostatic pressure in the course of immersing the plug into the fluid filling the well bore till the application of the plug within the troublesome zone.

It is another object of the present invention to provide higher quality of sealing jobs involved in eliminating troublesome zones in wells.

It is one more object of the present invention to avoid overexpenditure of plugging agents.

It is still more object of the present invention to retain a required quality of the quick-setting mixture till the beginning of its application within the troublesome zone, i.e., preventing its premature hydration, dilution and losing its activity and plugging ability.

It is yet still more object of the present invention to provide high productivity of the process for eliminating troublesome zones in wells.

The above objects are accomplished due to the fact that a plug for eliminating troublesome zones in wells, comprising a plugging agent in the form of a dry quick-setting mixture packed in an elastic water-proof cylindrical chamber having the same diameter as the well, the bottom end of said chamber being stoppered, while the top end is adapted for tightly closing the chamber after said plugging agent has been packed thereinto, according to the invention is provided with elastic retainers for closing the top end of the chamber, said top end being shaped as a double strip formed by the walls of the cylindrical chamber and defined by two peripheral longitudinal seams which run to the boundary line of the plugging agent, said strip being bent along said boundary line over the plug body so as to be forced thereagainst by said elastic retainers.

Such a practical embodiment of the method of closing the plug interior chamber provides for hermetic tightness and intactness of the walls thereof under conditions of a continuously rising all-round hydrostatic pressure in the course of immersing the plug into the fluid filling the well bore, till the moment of application in the troublesome zone.

Brief Description of the Drawings

Given below is a detailed description of a specific embodiment of the present invention given by way of illustration with reference to the accompanying drawings, wherein.

DETAILED DESCRIPTION OF THE INVENTION

Figure 1:
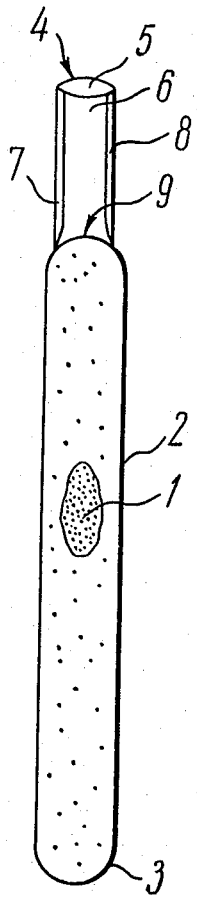
FIG. 1 is a front view of a plug for eliminating troublesome zones in wells, according to the invention with the open top end of the chamber thereof.

The plug for eliminating troublesome zones in wells comprises a plugging agent which is essentially a dry quick-setting mixture 1 (FIG. 1) packed in an elastic water-proof cylindrical chamber 2 having the same diameter as the well being treated, a bottom end 3 of the chamber 2 being stoppered.

A top end 4 of the chamber 2 which is adapted for a hermetically tight closing of the chamber 2 after having packed the mixture 1 therein, is shaped as a double strip formed by walls 5 and 6 of the cylindrical chamber 2 and defined by two longitudinal peripheral seams 7 and 8 running to a boundary line 9 of the mixture 1.

Figure 2:
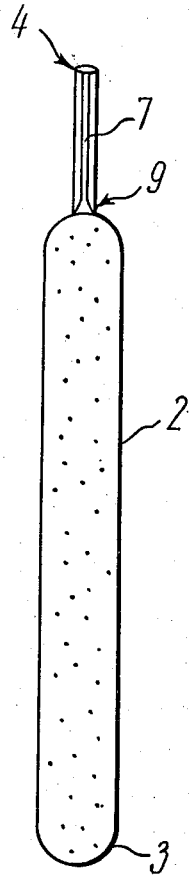
FIG. 2 is a side view of FIG. 1, according to the invention.

FIG. 2 illustrates a side view of the plug for eliminating troublesome zones in wells.

Figure 3:
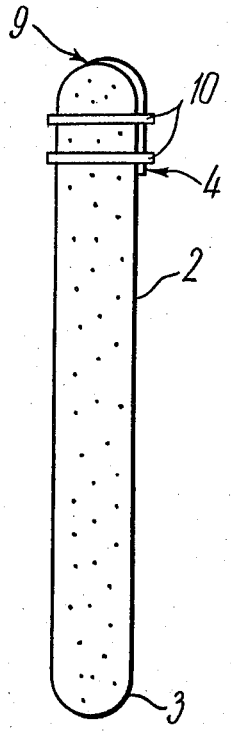
FIG. 3 is a side view of a plug for eliminating troublesome zones in wells, according to the invention with the closed top end of the chamber thereof.

The plug has elastic retainers made as rubber rings 10 (FIG. 3) adapted for said strip bent along the boundary line 9, to force against the plug body.

The plug is immersed into the well with the stoppered end 3 down. As the dry quick-setting mixture 1 (FIG. 1) gets compacted by virtue of all-round compression exerted thereupon by the fluid located in the well, the air expelled from the mixture 1 accumulates in the top portion of the chamber 2.

As soon as the pressure of the air bubble exceeds the elasticity of the rubber rings 10 (FIG.3) the air brings apart the walls 5 and 6 (FIG. 1) of the double strip while extending the rings 10 (FIG. 3) so as to escape from the chamber 2 of the plug.

Then the walls 5 and 6 (FIG. 1) of the strip are brought together immediately after air escaping, due to being acted upon by the hydrostatic pressure of the surrounding medium and by the elastic forces produced by the rubber rings 10, thus restoring the tightness of the plug.

Said process is repeated several times in the course of immersing the plug into the well till reaching the troublesome zone.

Application of the herein-proposed plug for eliminating troublesome zones in wells improves the quality and reliability of the plugging process, enables highly active quick-setting plugging mixtures to be stored for a lengthy period of time without being afraid of their premature hydration and degrading and be shipped over any distance, as well as makes it possible to save much valuable plugging agents.

What is claimed is:

1. A plug for insertion into a well comprising an elastic waterproof envelope defining a cylindrical chamber for accomodating a plugging agent, said envelope having a closed bottom and an open top, a plugging agent comprising a dry quick-setting mixture packed into said chamber to a level below said open top to define a free envelope top portion, said top portion being folded over substantially at said level and covering a part of the outer surface of said envelope below said level and at least one elastic retaining ring circumferentially surrounding said envelope over said top portion, said retaining ring tightly closing said open top of said envelope while allowing passage therethrough of pressurized air from within said chamber.

2. A plug as defined in claim 1, wherein said top portion of said envelope comprises strips of material connected by longitudinal seams extending to said level of the mixture.

3. A plug as defined in claim 1 or claim 2, including a pair of said elastic retaining rings circumferentially surrounding said envelope over said folded top portion.

* * * * *